United States Patent [19]

Airy et al.

[11] Patent Number: 4,718,665

[45] Date of Patent: Jan. 12, 1988

[54] EXERCISE DEVICE

[75] Inventors: James F. Airy; Thomas D. Kadavy, both of Bellevue, Wash.

[73] Assignee: Soma Dynamics Corporation, Bellevue, Wash.

[21] Appl. No.: 886,185

[22] Filed: Jul. 15, 1986

[51] Int. Cl.[4] ..... A63B 21/22

[52] U.S. Cl. ..... 272/132; 272/143; 128/77; 128/88

[58] Field of Search ..... 272/67, 131, 132, 143; 128/25 R, 77, 80 R, 80 C, 80 F, 88; 188/82.1, 82.2

[56] References Cited

U.S. PATENT DOCUMENTS

| | | | |
|---|---|---|---|
| 1,374,177 | 4/1921 | Barry | 128/88 |
| 2,714,507 | 8/1955 | Goodrich | 272/132 X |
| 2,777,439 | 1/1957 | Tuttle | 128/25 R |
| 2,791,920 | 5/1957 | Ray | 188/82.2 |
| 2,832,334 | 4/1958 | Whitelaw | 272/132 X |
| 3,495,824 | 2/1970 | Coinier | 272/67 X |
| 3,964,742 | 6/1976 | Carnielli | 128/25 R X |
| 3,976,057 | 8/1976 | Barclay | 128/25 R |
| 4,407,496 | 10/1983 | Johnson | 272/143 X |
| 4,436,303 | 3/1984 | McKillip et al. | 272/132 |
| 4,660,550 | 4/1987 | Bodine | 128/77 |

FOREIGN PATENT DOCUMENTS

| | | | |
|---|---|---|---|
| 747473 | 7/1980 | U.S.S.R. | 272/67 |

*Primary Examiner*—Richard J. Apley
*Assistant Examiner*—Robert W. Bahr
*Attorney, Agent, or Firm*—Seed and Berry

[57] ABSTRACT

An exercise device having a pair of pivotally interconnected lever arms coupled to a braking mechanims by a planetary gear system to resist pivotal movement between the lever arms. A brace mounted on each of the lever arms secures the lever arms to respective limbs of an exerciser that are connected to each other through a joint such as the knee or elbow.

8 Claims, 5 Drawing Figures

FIG. 1
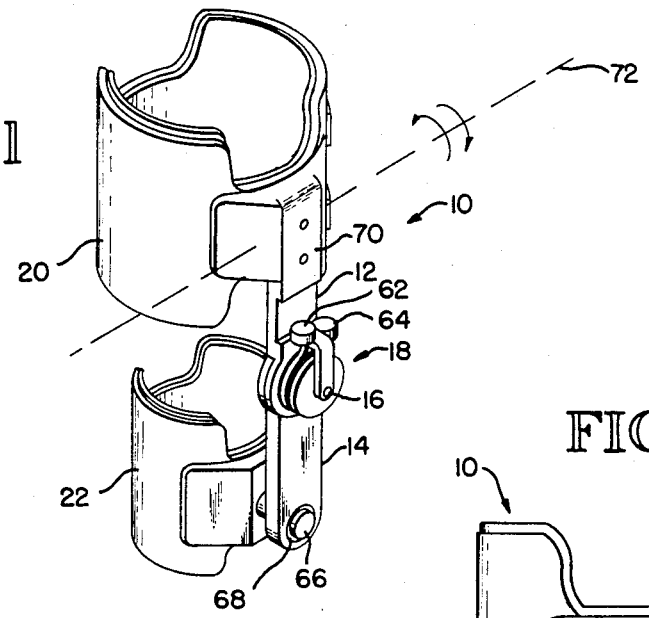
FIG. 2
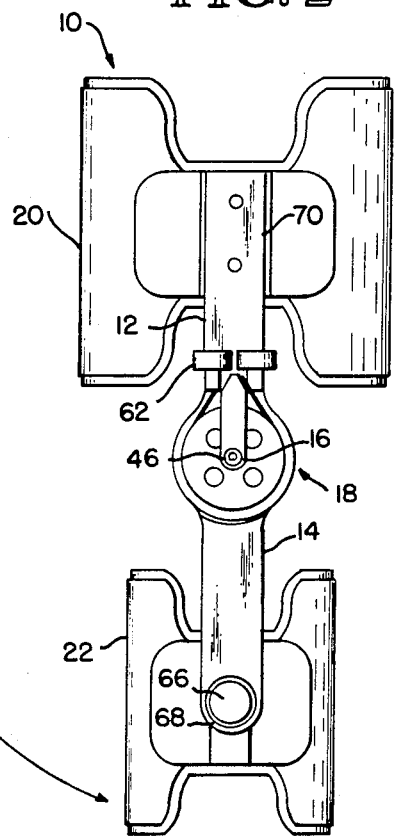
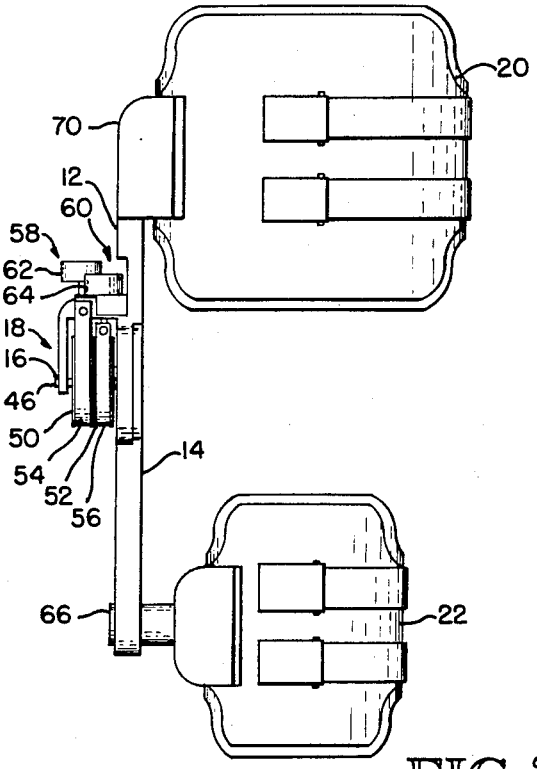
FIG. 3

EXERCISE DEVICE

DESCRIPTION

1. Technical Field

This invention relates to exercise devices, and more particularly, to exercise devices having a pair of pivotally mounted arms and a clutch for resisting pivotal movement between the arms so that the arms may be secured to a pair of pivotally interconnected limbs to exercise the muscles causing pivotal movement of the arms.

2. Background Art

Exercise devices are used for exercising a joint, muscle, tendon, or ligament and range in complexity from a simple weight to a complex electrical or mechanical system. A basic principle common to most exercise devices is a resistance to motion which the muscles must overcome. When the exercise device is a simple weight, the resistance to motion is a constant force. Other exercise devices frequently have some means for adjusting the resistance to motion, such as by adding weights to a weight bar or by adjusting the tension on a friction brake for an exercise bicycle.

Devices for exercising a joint include therapeutic devices, such as the brace described in U.S. Pat. No. 2,832,334, to Whitelaw. The Whitelaw brace includes two pivotally interconnected lever arms, a sling for attaching one lever arm to an exerciser's forearm, and a handgrip for attaching the other lever arm to the exerciser's hand so that the pivot between the lever arms is positioned on the pivot axis of the exerciser's wrist. An adjustable friction clutch controls the resistance to pivotal movement between the two lever arms.

Another therapeutic device, disclosed in U.S. Pat. No. 3,976,057 by Barclay, also includes two pivotally interconnected lever arms and a piston device extending between the lever arms. The piston device includes adjustable bleed valves capable of exerting calibrated and adjustable resistance to movement of a joint.

A problem with these and other exercise devices is the inability to independently adjust the force required to overcome the resistance to movement in each direction, particularly in a relatively compact configuration and at a relatively low cost.

3. Disclosure of the Invention

An object of this invention is to provide an exercise device having two pivotally interconnected lever arms and a clutch mechanism resisting pivotal movement, in which the resistance to pivotal movement in each direction is independently adjustable.

Another object of this invention is to provide a portable exercise device of the character described that is relatively compact, inexpensive, and maintenance free.

A further object of the invention is to provide an exercise device having a pair of pivotally interconnected lever arms in which the characteristic of the resistance to pivotal movement can be either constant or in proportion to the rate of pivotal movement.

These and other objects of the invention are provided by an exercise device having a first lever arm and a second lever arm connected by a pivot. The lever arms are coupled to a braking mechanism mounted on one of the lever arms. The braking mechanism may be independently adjustable to independently control the resistance to pivotal movement between said lever arms in each direction. Coupling between the lever arms and the braking mechanism may be accomplished by a gear train which may be of the planetary type.

BRIEF DESCRIPTION OF THE DRAWINGS

FIG. 1 is an isometric view of a preferred embodiment of the exercise device.

FIG. 2 is an elevational view of the exercise device of FIG. 1.

FIG. 3 is another elevational view of the exercise device of FIG. 1.

BEST MODE FOR CARRYING OUT THE INVENTION

Figure 4:
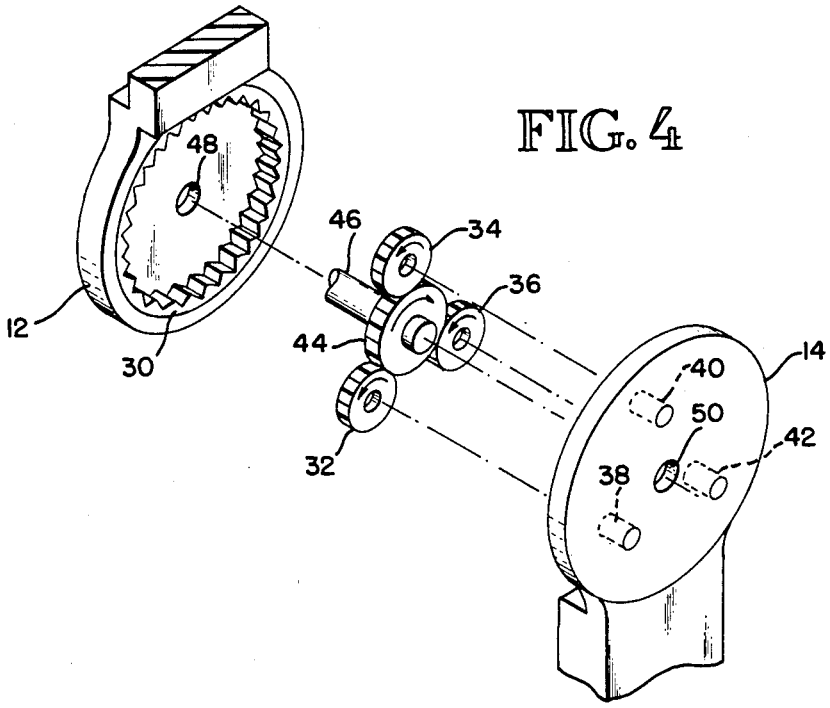
FIG. 4 is an exploded isometric view of the planetary gear system.

The exercise device 10 as best illustrated in FIGS. 1–3, includes a first lever arm 12 and second lever arm 14 connected by a pivot 16. A friction clutch 18 provides an adjustable resistance to pivotal movement between the first and second lever arms 12, 14, respectively, about pivot 16. A first brace 20 is also included for securing the first lever arm 12 to a human limb, while similarly, a second brace 22 is included for securing the second lever arm 14 to a human limb. The braces 20, 22 are secured to their respective limbs so that the pivot 16 is positioned approximately on the natural pivot axis between the two limbs.

In other embodiments, a second pair of pivotally interconnected lever ams 12, 14 could be secured between the braces 20, 22 on the side opposite the first pair of lever arms 12, 14.

Figure 5:
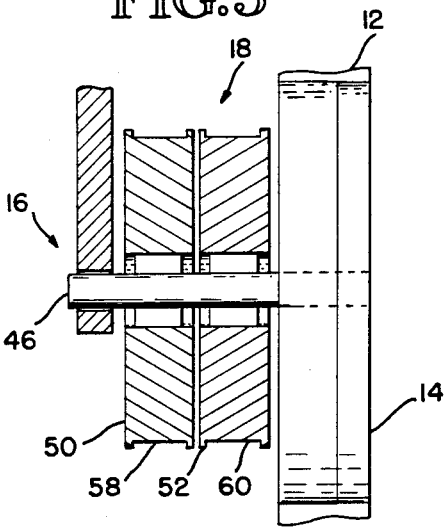
FIG. 5 is an elevational view of the pivot used in the exercise device of FIG. 1, with a cutaway view of the one-way roller clutches.

With reference also, now, to FIGS. 4 and 5, the preferred embodiment of the exercise device 10 includes a planetary gear system having a ring gear 30 press fit or otherwise mounted in a cylindrical recess in the first lever arm 12, three planet gears 32, 34 and 36 slidably mounted on respective bases 38, 40, 42 projecting from the second lever arm 14 and a sun gear 44 fixedly mounted on a central shaft 46. The sun gear 44 is positioned in the center of the ring gear 30, with the planet gears 32, 34 and 36 meshing with both the ring gear 30 and the sun gear 44. The shaft 46 is journaled in boxes 48, 50 in the first and second lever arms 12, 14, respectively, so that the sun gear 44 can freely rotate. The shaft 46 forms the pivot 16 between the first and second lever arms 12, 14 and secures the two lever arms to each other.

In operation, pivotal movement between the lever arms 12, 14 in one direction causes the ring gear 30 to rotate in the direction illustrated in FIG. 4. The planet gears 32, 34, 36 mesh with the ring gear 30 and, since they are rotatably mounted on respective bases 38, 40, 42 that are supported by the second lever arm 14, they rotate in the direction indicated. The planet gears, in turn, rotate the sun gear 44 in the direction shown in FIG. 4. Rotation of the sun gear 44 rotates the shaft 46 on which the ring gear is fixedly mounted. Thus, pivotal movement between the first and second lever arms 12, 14 in opposite directions causes the shaft 46 to rotate in opposite directions. As explained in detail below, the shaft 46 drives a braking mechanism in order to resist pivotal movement between the lever arms 12, 14.

With reference, also now, to FIG. 5, a braking mechanism includes a pair of conventional one-way roller clutches 50, 52 mounted on the central shaft 46 of the sun gear 44. Clutch 50 restricts rotation of shaft 46 in one direction, while clutch 52 restricts rotation of shaft 46 in an opposite direction. In the direction of rotation allowed by each roller clutch 50, 52, respectively, conventional friction belts 54, 56 and adjustment assemblies 58, 60 (FIG. 1) are used to determine the force required to rotate the shaft 46, and thus the force required to rotate one lever arm 12 about the other lever arm 14. As a result, the force required to produce pivotal movement in one direction is independently adjustable and the force required to produce pivotal movement in the opposite direction is independently adjustable.

In the preferred embodiment, the belt is made of a standard synthetic rubber received into respective grooves 58, 60 in the clutches 50, 52, although other materials may be used. Knobs 62, 64 adjust the tension in the belts 54, 56, respectively. The knobs 62, 64 may be calibrated in various units for identifying the force required to produce pivotal movement.

In embodiments having a second pair of pivotally interconnected lever arms on the opposite side of the joint being exercised, similar clutch-knob-belt assemblies or alternative assemblies may be used. Alternatively, the lever arms on one side may be allowed to freely pivot with all of the resistance to pivotal movement being provided by a friction clutch mounted on the other pair of lever arms.

While the clutch-knob-belt assembly described above is a preferred embodiment of a braking mechanism for adjusting the resistance to pivotal movement, force required to overcome the pivot in other embodiments could include varying assemblies or structures for accomplishing the same function. More particularly, the braking mechanisms can be of conventional designs in which the resistance to pivotal movement (i.e. torque) is directly proportional to the rate of pivotal movement. The braking mechanisms can also be of a conventional design employing friction members engaged by centrifugal force so that significant resistance to pivotal movement occurs only when the rate of pivotal movement exceeds a predetermined value.

The variety of suitable braking mechanisms allows the exercise device 10 to be relatively inexpensive. Moreover, the use of relatively compact braking mechanisms allows the exercise device 10 to be relatively compact. If desired, the braking mechanisms can be mounted on opposite sides of the lever arms 12, 14 and even recessed within the lever arms 12, 14 in order to further reduce the bulk of the exercise device. In this manner, it may be worn inside the pant leg of the exerciser.

Again with reference to FIGS. 1–3, the lever arm 14 includes a brace 22 for securing the exercise device 10 to a limb of the exerciser. Brace 22 is rotatably and pivotally mounted on lever arm 14 with a shaft 66 tightly surrounded by a resilient bushing 68 to allow the brace 22 to pivot with respect to the lever arm 14 to prevent the brace 22 from exerting a twisting movement on the limb. The first brace 20 is attached to the first lever arm 12 with a hinge 70 to allow pivotal movement of the brace 20 about an axis 72. Alternatively, the second brace 20 could be rigidly attached to the first lever arm 12. Each brace 20, 22 may include straps for securing the brace to a limb, though the braces 20, 22 may be constructed so that straps are not necessary. Alternatively, other securing devices, such as buttons or Velcro, could be used, or the braces could wrap 360° around the limb.

Although not shown in the preferred embodiment, a conventional electronic/mechanical counter could be used to count the number of repetitions of the pivotal movement.

While a preferred embodiment of this invention has been illustrated and described, the invention is capable of modification and addition without departing from its basic principles. Accordingly, the invention is not intended to be limited to the exact embodiment illustrated, which is presented only as an example. The scope of the invention should be determined by reference to the claims and their equivalents interpreted in light of the prior art.

We claim:

1. An exercise device comprising:

a first lever arm;

a second lever arm;

a pivot means for pivotally connecting said first lever arm to said second lever arm, so that said first lever arm can be pivoted with respect to said second lever arm in a first direction and in a second direction that is opposite said first direction;

first and second fasteners mounted on said first and second lever arms, respectively, for securing said lever arms to respective pivotally interconnected limbs of an exerciser with the pivot axis of said pivot means positioned approximately on the pivot axis of the joint pivotally interconnecting said limbs;

a gear mechanism having an output shaft that is coaxial with said pivot means, said gear mechanism converting pivotal movement between said first and second lever arms into rotation of said output shaft in respective first and second directions, said gear mechanism including a planetary gear system having a ring gear mounted on said first lever arm coaxially with said pivot means, a sun gear fixedly mounted on said output shaft, and a plurality of planet gears each meshing with said sun gear and said ring gear, said planet gear being rotatably mounted on said second lever arm so that pivotal movement between said first and second lever arms is transmitted to said output shaft in sequence through said ring gear, planet gears and sun gear; and a braking mechanism mounted on one of said lever arms, said braking mechanism being coupled to the output shaft of said gear mechanism and resisting rotation of said output shaft thereby resisting pivotal movement between said first and second lever arms in said first and second directions.

2. An exercise device comprising:

a first lever arm;

a second lever arm;

a pivot means for pivotally connecting said first lever arm to said second lever arm, so that said first lever arm can be pivoted with respect to said second lever arm in a first direction and in a second direction that is opposite said first direction;

first and second fasteners mounted on said first and second lever arms, respectively, for securing said lever arms to respective pivotally interconnected limbs of an exerciser with the pivot axis of said pivot means positioned approximately on the pivot axis of the joint pivotally interconnecting said limbs;

a gear mechanism having an output shaft, said gear mechanism converting pivotal movement between said first and second lever arms into rotation of said output shaft in respective first and second directions;

a braking mechanism mounted on one of said lever arms, said braking mechanism being coupled to the output shaft of said gear mechanism and resisting rotation of said output shaft, thereby resisting pivotal movement between said first and second lever arms in said first and second directions; and a first brace securing said first lever arm to a first human limb, said first brace being pivotally attached to said first lever about an axis that is perpendicular to a pivot axis between said first and second lever arms; and a second brace securing said second lever arm to a second human limb, said second brace being attached to said second lever arm through a pivot joint that allows universal pivotal movement between said second brace and said second lever arm.

3. An exercise device comprising:

a first lever arm;

a second lever arm;

a pivot means for pivotally connecting said first lever arm to said second lever arm, so that said first lever arm can be pivoted with respect to said second lever arm in a first direction and in a second direction that is opposite said first direction;

first and second fasteners mounted on said first and second lever arms, respectively, for securing said lever arms to respective pivotally interconnected limbs of an exerciser with the pviot axis of said pivot means positioned approximately on the pivot axis of the joint pivotally interconnecting said limbs;

a braking mechanism mounted on one of said lever arms, said braking mechanism resisting pivotal movement between said first and second lever arms in said first and second directions, said braking mechanism being independently adjustable so that the resistance to pivotal movement in said first direction can be different from the resistance to pivotal movement in said second direction;

a first brace securing said first lever arm to a first human limb, said first brace being pivotally attached to said first lever arm about an axis that is perpendicular to a pivot axis between said first and second lever arms; and a second brace securing said second lever arm to a second human limb, said second brace being attached to said second lever arm through a pivot joint that allows universal pivotal movement between said second brace and said second lever arm.

4. An exercise device, comprising:

a first lever arm;

a first brace adapted to secure said first lever arm to a first limb of an exerciser;

a second lever arm;

a second brace adapted to secure said second lever arm to a second limb of said exerciser, said second limb being pivotally secured to said first limb through a joint;

a shaft extending through a respective end of each of said lever arms to allow said lever arms to pivot with respect to each other;

a ring gear mounted on said first lever arm coaxially with said shaft;

a sun gear fixedly mounted on said shaft;

a plurality of planet gears each meshing with said ring gear and said sun gear, said planet gears being rotatably mounted on respective bosses projecting from said second lever arm so that pivotal movement between said lever arms rotates said shaft through said ring gear, plane gears and sun gear; and a braking mechanism mounted on one of said lever arms, said braking mechanism being coupled to said shaft to resist rotation of said shaft and thus pivotal movement between said lever arms.

5. The exercise device of claim 4 wherein said braking mechanism is independently adjustable for rotation of said shaft in each direction of rotation so that the resistance to pivotal movement between said lever arms in one direction can be adjusted independently from the resistance to pivotal movement in the opposite direction.

6. The exercice device of claim 4 wherein said braking mechanism comprises a first and a second one-way roller clutch mounted on said shaft and permitting free rotational movement between said roller clutches and said output shaft in opposite directions, and first friction means for resisting rotation of said first roller clutch and second friction means for resisting the rotation of said second roller clutch.

7. The exercise device of claim 6 wherein said first and second friction means include a pair of belts surrounding the peripheries of said first and second roller clutches, respectively, said belts each having their ends anchored to one of said lever arms, said belts surrounding the respective roller clutches with sufficient force to restrain rotation of said roller clutches.

8. The exercise device of claim 7 further including adjusting means for manually adjusting the tension on said belts, thereby adjusting the force with which said belts surround the peripheries of their respective roller clutches.

* * * * *